US005560764A

United States Patent [19]

Wachi et al.

[11] Patent Number: 5,560,764

[45] Date of Patent: Oct. 1, 1996

[54] ELECTROLESS GOLD PLATING SOLUTION

[75] Inventors: Hiroshi Wachi, Koza-gun; Yutaka Otani, Hiratsuka, both of Japan

[73] Assignee: Electroplating Engineers of Japan, Limited, Tokyo, Japan

[21] Appl. No.: 514,763

[22] Filed: Aug. 14, 1995

[30] Foreign Application Priority Data

Aug. 19, 1994 [JP] Japan ..... 6-195350

[51] Int. Cl.[6] ..... C23C 18/52

[52] U.S. Cl. ..... 106/123; 106/1.26

[58] Field of Search ..... 106/1.23, 1.26

[56] References Cited

U.S. PATENT DOCUMENTS

| | | | |
|---|---|---|---|
| 3,700,469 | 10/1972 | Okinaka | 106/1.26 |
| 4,307,136 | 12/1981 | Prost-Tournier et al. | 106/1.23 |
| 4,337,091 | 6/1982 | El-Shazly et al. | 106/1.26 |
| 4,792,469 | 12/1988 | Saito et al. | 106/1.23 |
| 4,978,559 | 12/1990 | Iacovangelo | 106/1.23 |
| 4,985,076 | 1/1991 | Iacovangelo | 106/1.26 |
| 5,035,744 | 7/1991 | Nishiyama et al. | 106/1.23 |
| 5,292,361 | 3/1994 | Otsuka et al. | 106/1.28 |

FOREIGN PATENT DOCUMENTS

| | | |
|---|---|---|
| 52-124428 | 10/1977 | Japan . |
| 55-24914 | 2/1980 | Japan . |
| 56-152958 | 11/1981 | Japan . |
| 59-229478 | 12/1984 | Japan . |
| 60-121274 | 6/1985 | Japan . |
| 62-99477 | 5/1987 | Japan . |
| 3-02471 | 3/1991 | Japan . |

OTHER PUBLICATIONS

Communication dated Nov. 28, 1995 in EP95305654.6 (1 page).

European Search Report, Nov. 21, 1995, for EP95305654 (1 page).

*Primary Examiner*—Helene Klemanski

*Attorney, Agent, or Firm*—Watov & Kipnes, P.C.

[57] ABSTRACT

The present invention provides an electroless gold plating solution which offers deposition layers exactly onto predetermined areas on the surface of the workpiece, without undesirable spread of prated areas. The electroless gold plating solution according to the invention contains 2–20 g/l of dimethylamine as amine group.

9 Claims, No Drawings

ELECTROLESS GOLD PLATING SOLUTION

BACKGROUND OF THE INVENTION (1) Field of the Invention

The invention relates to an electroless gold plating solution, and more particularly an alkaline electroless gold plating solution.

(2) Description of the Prior Art

A conventional alkaline electroless gold plating solution is applied in such a state as to raise an alkalinity by adding herein a pit adjustor such as potassium hydroxide. However, an excessively high alkalinity will undesirably accelerate the decomposition of the solution, although it increases the deposition rate of gold. Thus, a technique for eliminating such inconvenience described above has been disclosed in Japanese Laid-open Patent Publication No. Sho 62-99477 which uses amines such as triethanolamine to attain a desired alkalinity in addition to a pH adjustor such as potassium hydride.

A problem about triethanolamine is that it is strongly adsorbed to the plating site, which causes unwanted deposition of gold. For example, in an attempt to deposit gold onto metallized parts only on the surface of a workpiece, small amount of gold may deposit outside those areas. This may result in undesired electrical continuity between separate plated parts arranged at a short distance.

The present invention aims at elimination of such problems associated with conventional plating solutions, and provides an electroless gold plating solution from which gold deposits exactly onto desired parts of the workpiece without undesirable spread of the plated area.

SUMMARY OF THE INVENTION

The electroless gold plating solution according to the invention contains, as amine group, 2–20 g/l of dimethylamine (DMA hereinafter). A DMA concentration less than 2 g/l decreases the deposition rate of gold, while a concentration more than 20 g/l accelerates the decomposition of the liquid.

DMA, which has a low boiling point, is only weakly adsorbed onto the plating site, and thus prevents unwanted spread of gold deposition area outside predetermined parts to be plated, while retaining the characteristics of amines to maintain the deposition rate and prevent decomposition of the solution.

The electroless gold plating solution according to the invention contains gold in a form of an alkali metal gold cyanide, such as potassium gold cyanide or sodium gold cyanide, the former being the preferred form. A preferable concentration range of gold is 0.5–8 g/l (as Au metal).

As the reducing agent are used boron-based substances, such as dimethylaminoborane, boron potassium hydride, or boron sodium hydride. A preferable concentration range of the reducing agent is 1–30 g/l.

The electroless gold plating solution according to the invention may, in addition, contain an alkali metal cyanide, specifically sodium cyanide or potassium cyanide, when the stability of the self-catalyzing process is especially needed. A preferable concentration range of such a cyanide is 0.1–10 g/l.

Further, the plating solution may contain 0.1–50 ppm of thallium or lead in a compound form such as thallium formate, thallium sulfate, thallium oxide, thallium malonate, thallium chloride, lead citrate, lead acetate or lead oxide, thallium formate being particularly convenient because of a low toxicity.

Along with the thallium and/or lead compounds mentioned above, the solution may contain 0.1–10 g/l, or preferably 0.5–2 g/l, of a chelating agent, such as diethylenetriaminepentaacetic acid, ethyle nediaminetetraacctic acid, or nitrilotriacetic acid, the first being a preferable agent. Such a chelating agent prevents precipitation of gold even at high concentrations of the thallium or lead compound mentioned above, thus allowing addition of a more manageable amount of such a metal compound to the plating solution.

The pH value of the solution should preferably be kept in a range from 11 to 14. An alkali metal hydroxide, such as sodium hydroxide or potassium hydroxide is a pH adjustor to maintain such pH level.

Plating operations using the solution should preferably performed at a temperature of 50°–80° C.

It should be noted that the content of the invention is not limited to the above description, and the objects, advantages, features, and usages will become more apparent according to descriptions below. It is also to be understood that any appropriate changes without departing from the spirit of the invention arc in the scope of the invention.

DETAILED DESCRIPTION OF THE PREFERRED EMBODIMENTS

Embodiments of the present invention will be described hereinafter.

First Embodiment

TABLE 1

| | |
|---|---|
| Gold potassium cyanide | 4 g/l as gold |
| Dimethylamineborane | 8 g/l |
| Thallium formate | 10 ppm as thallium |
| Nitrilotriacetic acid | 2 g/l |
| Potassium hydroxide | 35 g/l |
| Potassium cyanide | 2 g/l |

TABLE 2

| | |
|---|---|
| Temperature | 70° C. |
| pH | 14 |
| Plating time | 30 min. |

Various amounts of DMA were added to an electroless gold plating solution of the composition presented above prepared using guaranteed reagents. The deposits obtained were evaluated. The evaluation was performed for checking to see the portions to be plated have no deposit squeezed out, and on the deposit rate. A pair of metalized parts were spaced on the workpiece at a distance of 100 μm, onto which gold was deposited using the solution above, and the electrical continuity between the two gold-plated parts were checked. The plating was performed until the thickness of the deposited layer reached 2 μm, and the deposition rates were measured. Deposits obtained had a uniform lemon-yellow color and presented no problem in the appearance. Reference examples contained triethanolamine instead of DMA.

TABLE 3

| No. | | DMA additives (g/l) | Evaluation | Deposition rate (μm/hr) |
|---|---|---|---|---|
| Examples | 1 | 2 | ○ | 3.0 |

TABLE 3-continued

| No. | | DMA additives (g/l) | Evaluation | Deposition rate (μm/hr) |
|---|---|---|---|---|
| | 2 | 5 | ○ | 4.0 |
| | 3 | 10 | ○ | 5.0 |
| | 4 | 20 | ○ | 7.0 |
| Comparative Example | 5 | triethanolamine | X | 4.0 |

Evaluation ○: No continuity between gold-plated parts.
X: Continuity between gold-plated parts.

As the results shown in Table 3 indicate, in the Examples wherein the solutions containing DMA, only the interior or the metalized parts are gold-plated, thereby giving no continuity between the gold-plated parts. While the solution used in the Reference Example containing triethanolamine resulted in an electrical continuity between the metalized parts abutting each other, because gold deposited also outside the metalized parts on the surface of the workpiece. The addition or DMA did not lead to a deposition rate inferior to that with triethanolamine. Early decomposition of the solution was not observed in any case.

Second Embodiment

TABLE 4

| | |
|---|---|
| Gold potassium cyanide | 4 g/l as gold |
| Boron potassium hydride | 20 g/l |
| Thallium formate | 10 ppm as thallium |
| Nitrilotriacetic acid | 2 g/l |
| Potassium hydroxide | 10 g/l |
| Potassium cyanide | 3 g/l |

TABLE 5

| | |
|---|---|
| Temperature | 70° C. |
| pH | 13 |
| Plating time | 30 min. |

In this example where boron potassium hydride was used as the reducing agent, addition of 2–20 g/l of DMA led to results similar to those in Example 1 above.

The electroless gold plating solution according to the invention, as described above, offers deposition layers exactly onto predetermined areas on the surface or the workpiece, without undesirable spread of plated areas, and is therefore well suited for plating onto very small areas.

What is claimed is:

1. An electroless gold plating solution containing an alkaline metal gold cyanide, a baron-based reducing agent, and an alkali metal hydroxide, wherein 2 to 20 g/l of dimethylamine is added to said solution.

2. An electroless gold plating solution as defined in claim 1 wherein said solution contains at least one of the boron-based reducing agents selected from the group consisting of dimethylaminoborane, boron potassium hydride, and boron sodium hydride.

3. An electroless gold plating solution as defined is claim 1 wherein the concentration of the reducing agent is 1 to 30 g/l.

4. An electroless gold plating solution as defined in claim 2 wherein the concentration of the reducing agent is 1 to 30 g/l.

5. An electroless gold plating solution as defined in claim 1, which has a pH value of 11 to 14.

6. An electroless gold plating solution as defined in claim 2, which has a pH value of 11 to 14.

7. An electroless gold plating solution as defined in claim 3, which has a pH value of 11 to 14.

8. An electroless gold plating as solution defined in claim 4, which has a pH value of 11 to 14.

9. An electroless gold plating solution as defined in claim 1 wherein an alkali metal cyanide is contained.

* * * * *

UNITED STATES PATENT AND TRADEMARK OFFICE

CERTIFICATE OF CORRECTION

PATENT NO. : 5,560,764

DATED : October 1, 1996

INVENTOR(S) : Hiroshi Wachi and Yutaka Otani

It is certified that error appears in the above-indentified patent and that said Letters Patent is hereby corrected as shown below:

Column 4,

Claim 3, line 1, change "is" to --in--.

Claim 8, line 1, change "as solution" to --solution as--.

Signed and Sealed this

Fourth Day of February, 1997

*Attest:*

Bruce Lehman

BRUCE LEHMAN

*Attesting Officer*

*Commissioner of Patents and Trademarks*